US010052504B2

(12) United States Patent
Volmer et al.

(10) Patent No.: US 10,052,504 B2
(45) Date of Patent: Aug. 21, 2018

(54) SYSTEM AS WELL AS PROCESS FOR TRANSMITTING DATA AND/OR DEVICE-SPECIFIC PARAMETERS BETWEEN A BLOWER FILTER DEVICE OF A BLOWER FILTER SYSTEM AND A COMPUTER

(71) Applicants: Achim Volmer, Lübeck (DE); Mirco Frösch, Stockelsdorf (DE); Olaf Balke, Reinfeld (DE)

(72) Inventors: Achim Volmer, Lübeck (DE); Mirco Frösch, Stockelsdorf (DE); Olaf Balke, Reinfeld (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 391 days.

(21) Appl. No.: 14/011,969

(22) Filed: Aug. 28, 2013

(65) Prior Publication Data

US 2014/0060538 A1 Mar. 6, 2014

(30) Foreign Application Priority Data

Aug. 29, 2012 (DE) ..... 10 2012 017 094

(51) Int. Cl.
*A62B 18/08* (2006.01)
*A62B 18/02* (2006.01)
(Continued)

(52) U.S. Cl.
CPC ..... *A62B 18/08* (2013.01); *A62B 7/10* (2013.01); *A62B 7/12* (2013.01); *A62B 18/02* (2013.01); *A62B 18/006* (2013.01)

(58) Field of Classification Search
CPC .. A62B 18/08; A62B 7/10; A62B 7/12; A62B 18/02; A62B 18/006; A62B 18/045;
(Continued)

(56) References Cited

U.S. PATENT DOCUMENTS 6,718,547 B2 * 4/2004 Takeo ..... G06F 8/65 717/170
7,717,112 B2 * 5/2010 Sun ..... A61B 5/0002 128/200.24
(Continued)

FOREIGN PATENT DOCUMENTS

GB 2 478 759 A 9/2011
JP 2002-301155 A 10/2002
(Continued)

*Primary Examiner* — Peter S Vasat
*Assistant Examiner* — Margaret Luarca
(74) *Attorney, Agent, or Firm* — McGlew and Tuttle, P.C.

(57) ABSTRACT

A system includes a blower filter system (20), having a blower filter device (1), a head piece (21) and a flexible connection hose (22), connecting the blower filter device (1) and the head piece to one another in a fluid-communicating manner. A computer (30) is separated in space from the blower filter system. The computer has a communication interface (31), which is designed to transmit data from the computer to the control unit (6) of the blower filter device and/or to receive data from the control unit of the blower filter device to the computer. The blower filter device has at least one communication interface (7) for transmitting data from the control unit to an external computer and/or for receiving data sent from an external computer to the control unit. A process is provided for checking and setting device-specific parameters of the blower filter device of the blower filter system.

12 Claims, 3 Drawing Sheets

(51) Int. Cl.
*A62B 7/10* (2006.01)
*A62B 7/12* (2006.01)
*A62B 18/00* (2006.01)

(58) Field of Classification Search
CPC ..... G08C 17/00; G08C 19/00; G06F 8/65; G06F 19/3412; G06F 9/4411
USPC ..... 128/204.21; 96/424
See application file for complete search history.

(56) References Cited

U.S. PATENT DOCUMENTS

| | | | | |
|---|---|---|---|---|
| 2006/0125623 | A1* | 6/2006 | Appelt | A61B 5/02055 340/521 |
| 2009/0229610 | A1* | 9/2009 | Oates | A61M 16/0057 128/204.21 |
| 2009/0266361 | A1 | 10/2009 | Bilger et al. | |
| 2010/0224190 | A1 | 9/2010 | Tilley et al. | |
| 2011/0289497 | A1* | 11/2011 | Kiaie | G06F 8/65 717/171 |

FOREIGN PATENT DOCUMENTS

| | | | |
|---|---|---|---|
| JP | 2003-117013 | A | 4/2003 |
| WO | 2007/030877 | A1 | 3/2007 |
| WO | 2009/067583 | A2 | 5/2009 |
| WO | 2011/053754 | A1 | 5/2011 |
| WO | 2011/115754 | A1 | 9/2011 |

* cited by examiner

SYSTEM AS WELL AS PROCESS FOR TRANSMITTING DATA AND/OR DEVICE-SPECIFIC PARAMETERS BETWEEN A BLOWER FILTER DEVICE OF A BLOWER FILTER SYSTEM AND A COMPUTER

CROSS REFERENCE TO RELATED APPLICATIONS

This application claims the benefit of priority under 35 U.S.C. § 119 of German Patent Application DE 10 2012 017 094.7 filed Aug. 29, 2012, the entire contents of which are incorporated herein by reference.

FIELD OF THE INVENTION

The present invention pertains to a system comprising a blower filter system having a blower filter device with at least one filter, with a fan wheel arranged in a fan housing, with a motor for driving the fan wheel as well as with a control unit for actuating the motor and for processing device-specific parameters of the blower filter device, furthermore having a head piece and a flexible connection hose, which connects the blower filter device and the head piece in a fluid-communicating manner, and comprising a computer. Furthermore, the present invention pertains to a process for checking and setting device-specific parameters of a blower filter device of a blower filter system.

BACKGROUND OF THE INVENTION

Blower filter systems are used for light and medium respiratory protection devices and support the user of respirator filters by reducing the respiration resistance, contrary to conventional gas masks, and thus making long-term use without fatigue possible. A blower filter system comprises the following principal components: A blower filter device worn mostly on a belt and a head piece, which is designed as a hood or mask. These two components are usually connected to one another via a flexible hose. The contaminated air is suctioned through a filter by means of the blower filter device, as a result of which it is freed from harmful substances and is subsequently sent via a flexible hose to the head piece and to the user of the respirator. The blower filter device itself comprises, among other things, a fan wheel driven by a motor and a spiral housing. The energy for the blower unit is made available usually by a battery. In addition, there exists a central control unit, which controls the motor of the blower unit and can process inputs of the user. A housing encloses, in general, the blower unit, control unit and battery. At least one filter can be connected to the housing. Besides the main function of transporting air, the blower filter device additionally informs the user of the current operating state as well as cases of defect by means of visual or acoustic signals.

Prior-art blower filter devices are closed systems, whose functionality cannot be expanded during their lifecycle. Blower filter devices are known which make it possible to recognize the connected filter and the head piece and derive an automatic configuration of the system from these data. If the corresponding software for setting the blower filter device of the newly connected filter or head piece is not known to the blower filter device, a corresponding configuration of the blower filter device cannot be performed. The blower filter device or the blower filter system has limited flexibility as a result.

SUMMARY OF THE INVENTION

An object of the present invention is to at least partially eliminate the above-described drawbacks in such blower filter systems. In particular, it is an object of the present invention to make available a system as well as a process for checking and setting device-specific parameters of a blower filter device of a blower filter system, which make it possible to flexibly and rapidly adapt the functionality of the blower filter system in a cost-effective and simple manner.

The above object is accomplished by a system according to the invention as well as a process for checking and setting device-specific parameters of a blower filter device of a blower filter system according to another aspect of the invention. Further features and details of the present invention appear from the specification and drawings. Features and details that are described in connection with the system according to the present invention also apply, of course, in connection with the process according to the present invention and vice versa, so that reference is or can always be made mutually to the individual aspects of the present invention.

According to a first aspect of the present invention, the object is accomplished by a system comprising a blower filter system having a blower filter device with at least one filter, with a fan wheel arranged in a fan housing, with a motor for driving the fan wheel as well as with a control unit for actuating the motor and for processing device-specific parameters of the blower filter device, furthermore having a head piece and a flexible connection hose, which connects the blower filter device and the head piece to one another in a fluid-communicating manner. The system comprises, furthermore, a computer separated in space from the blower filter system, wherein said computer has a communication interface, which is designed to transmit data from the computer to the control unit of the blower filter device and/or to receive data sent from the control unit of the blower filter device to an external computer and/or to receive data sent from an external computer to the control unit.

A system designed in this manner makes possible the flexible and rapid adaptation of the functionality of the blower filter system in a cost-effective and simple manner. This means that the blower filter system can be reconfigured in a simple manner in case of replacement of components, for example, of a filter or a head piece and made safe for a user. The functionality of the blower filter device can be expanded in a flexible manner due to the possibility of transmitting data and device-specific parameters between the control unit of the blower filter device and the computer of the blower filter system. Such a system thus makes it possible to expand the scope of functions of blower filter systems, especially of the blower filter device of blower filter systems.

The blower filter device of the blower filter system may have one or more filters. It is, of course, also possible to use other suction systems instead of a fan wheel in order to suction ambient air and to purify it through at least one filter arranged downstream. The motor of the blower filter device may be preferably driven with a battery. However, it is also conceivable that current is fed to the blower filter device by means of a cable. The control unit of the blower filter device is used, on the one hand, to actuate the motor and, furthermore, to process the device-specific parameters of the blower filter device. The control unit preferably has a memory unit, in which data and device-specific parameters, especially software for operating the blower filter system, are stored.

The blower filter system preferably has a carrying system, especially a belt, which makes it possible for a user to easily carry the blower filter device. In particular, a belt on which the blower filter device is arranged, makes easy carrying possible in any working environment. Especially helmets, hoods, visors or masks may be used as the head piece. An air stream, which can be exactly adapted to the individual needs and freely regulated depending on application for helmets, hoods, visors and masks, can be fed from the blower filter device to the head piece via the flexible connection hose. Furthermore, a multifunction control panel, via which the user of the blower filter system can perform settings individually, may be associated with the blower filter device via a user interface.

The computer separated in space from the blower filter system makes it possible to perform settings and modifications, especially configurations, on the blower filter system, especially the blower filter device, from the outside. In particular, the computer makes it possible to transmit data and device-specific parameters to the control unit of the blower filter device in order to expand the functionality of the latter. Both the computer and the blower filter device have corresponding communication interfaces for this, via which data can be sent and received.

The system makes it possible for a user of the blower filter system or especially a service technician working on the blower filter system to connect the blower filter system with the computer via the communication interface and thus to exchange data between the blower filter system and the computer. On the one hand, the computer can easily receive operating information of the blower filter system, and, on the other hand, the computer can transmit most recent data, especially current firmware, to the blower filter system. As a result, the computer is informed of the operating data and operating settings of the blower filter system. Furthermore, the blower filter system can always be kept at the current state of the art.

The communication interfaces of the blower filter housing as well as of the computer may be physical interfaces for connecting a cable between the computer and the blower filter device. A service technician only needs to connect the blower filter system and the computer with a cable in order to read data from the blower filter system or to download firmware to the blower filter system. According to an especially preferred further variant of the present invention, provisions may be made in a blower filter system for the communication interfaces to be wireless interfaces. The wireless interfaces may be designed according to the different prior-art standards. For example, Bluetooth interfaces, ZigBee interfaces, ANT+ interfaces or other wireless interfaces, such as WLAN interfaces, may be provided. It is advantageous in wireless interfaces that the transmission of data and device-specific parameters is possible over great distances without a major effort. For example, the computer of the blower filter system may thus be associated with a service server of a manufacturer of such blower filter systems, and corresponding adaptations of the blower filter system can be performed via said service server. Another advantage of wireless interfaces is that the service technician does not need to connect any cable to the blower filter system and the computer.

Provisions may advantageously be made in a system for the communication interface of the blower filter device to be designed to receive software updates for the control unit from the computer. If a blower filter device has no corresponding software for a newly connected component, for example, a newly connected filter or a newly connected head piece, a corresponding software update can be sent by the computer via the communication interfaces to the control unit, so that the blower filter device can be adapted to the newly connected components in a flexible manner.

Especially preferred is a system in which the blower filter device has a detecting means for detecting device-specific parameters, especially device-specific software settings, which is connected to the control unit to transmit the device-specific parameters detected to the control unit. This means that the detecting means is used to recognize changes in the device-specific parameter system, especially changes on components such as head pieces, filters, batteries, fan wheels, and to communicate these to the control unit. The detecting means may have, for example, sensors, which recognize changes in the components of the blower filter system.

The changes in the blower filter system detected by the detecting means can be processed by the control unit of the blower filter device.

According to an especially preferred variant of the present invention, provisions may be made in a system for the blower filter system, especially the computer, to have a checking unit for detecting the up-to-date status of the device-specific parameters, especially of the device-specific software, of the computer of the blower filter device. This means that the checking unit may be provided in the blower filter device. However, the checking unit is preferably associated with the computer of the blower filter system. The device-specific parameters detected by the detecting means can be checked for their up-to-date status in the checking unit. If the checking unit detects that device-specific parameters are incorrect or do not fit the corresponding components of the blower filter system, the checking unit can pass this on to the computer, and corresponding adaptations can be performed by the computer. For example, a corresponding software update can be transmitted from the computer to the control unit of the blower filter device via the communication interfaces if it is detected that there is no corresponding software for a connected head piece in the control unit of a blower filter device, so that a corresponding adaptation or expansion of the functionality of the blower filter device can be performed in the control unit. It is thus made possible in a simple and cost-effective manner to adapt a blower filter system, especially the blower filter device of a blower filter system, to new situations. Furthermore, it is possible in a simple and cost-effective manner to make changes in the device-specific parameters by means of the computer. For example, it is possible to adjust the volume of an acoustic alarm of a display system associated with the blower filter device. Furthermore, it is possible to perform an adaptation of the user interface on the computer. For example, the keyboard can be locked when this is required by situation. In particular, most up-to-date data sets can be provided via the computer for the correct, automatic configuration of the blower filter system in case of an expansion by new components, such as new filters or new head pieces.

Preferred is a system in which the control unit of the blower filter device is designed for the automatic transmission of the device-specific parameters to the computer. This means that, for example, immediately after switching on the blower filter system, especially the blower filter device, the computer passes on data and device-specific parameters to the computer via the communication interfaces, so that if an incorrect configuration of the blower filter device is detected or if changes in the device-specific parameters are detected, a corresponding adaptation can be made by the computer by corresponding data sets being transmitted from the computer to the blower filter device.

Besides the modification of the properties of the blower filter devices, the integration of the communication interfaces allows access to device properties and statistics, which are obtained during the operation of the blower filter system. For example, the following parameters can thus be read by the detecting unit and subsequently by the computer:

Total run time of the blower filter system,

The run time of the blower filter device relative to a corresponding type of filter, The run time of the blower filter device relative to a corresponding system configuration, for example, the configuration for a head piece, Statistics on alarms and warnings, Battery charge cycles and residual battery capacities.

Other device-specific parameters, such as temperatures, air flow rates, etc., may, of course, be read as well. The computer makes it possible to make predictions on the remaining service life of the blower filter system, especially of the blower filter device of the head piece, etc., from these data or device-specific parameters, especially on the basis of wear models. The computer can thus support the user in planning the lifecycle of the blower filter system being used and guarantee the early purchase of spare parts and replacement parts. The computer can be connected via a service computer to the Internet, via which the distribution of the current configuration data sets and of the firmware is made possible. A data bank or list, which monitors the device-specific parameters and settings of each and every blower filter system and can determine the status of the corresponding system as a result, can be maintained in the computer or a central service server associated with the computer. It can thus be ensured that users of blower filter devices or blower filter systems are always provided the most recent data and settings and notification is made possible in case of malfunctions. On the other hand, the bringing together of the statistical information from the blower filter systems in the computer or in a central service server connected with the computer makes it possible to form an accurate model for predicting failure probabilities and preventive maintenance of blower filter systems. Furthermore, it is possible, based on the information collected in the data bank, to infer blower filter systems from a plurality of blower filter systems and to perform, as a result, changes on the blower filter systems in a specific manner. A statistical analysis is possible on the basis of the data bank.

The system makes it possible, in particular, to check whether a blower filter system is being used correctly. It can thus be easily determined how and for how long a user has used a blower filter system. All computers can be connected with the service computer or a central service server. The data and information transmitted from the blower filter systems to the respective computers can be passed on by the computers to the service computer or to the central service server. All data and information on the blower filter systems can be performed there. Data can thus be obtained for improvements on the blower filter systems on the basis of an analysis of the data and information in the service computer or in the central service server.

A control unit, which is designed to automatically transmit the device-specific parameters to the computer, makes direct access to the systems settings of a blower filter device possible. A corresponding adaptation of the functionality of the blower filter system can thus be performed especially immediately after the switching on of a blower filter system or of a blower filter device.

Furthermore, a system is preferred in which the control unit of the blower filter device is designed for the periodic transmission of the device-specific parameters to the computer. As a result, changes on the blower filter system, especially in the nature and status of individual components of the blower filter system, for example, of the filters, can be detected rapidly and accurately and transmitted to the computer. The safety of the blower filter system is markedly increased hereby, because errors can be detected rapidly. For example, transmission of the device-specific parameters from the control unit to the computer can take place at an interval of, for example, one hour or a few minutes.

According to a preferred variant of the present invention, provisions may be made in a system for the checking unit to be designed for automatically, especially periodically polling the device-specific parameters of the blower filter device and for the computer to be able to transmit data, especially software updates or device-specific setting data to the control unit of the blower filter device via the communication interfaces as a function of the device-specific parameters of the blower filter device. This means that regardless of whether the checking unit is arranged in the blower filter device or in the computer of the blower filter system, the checking unit can perform a polling of the settings and device-specific parameters of the blower filter device automatically, especially at regular time intervals, in order to subsequently make changes, if needed, in the settings or the software of the blower filter device. It is ensured hereby that the blower filter system is configured optimally. Especially if the checking unit is arranged in the computer, access is possible in a simple manner to the blower filter device from the outside and a checking can be performed to determine whether the blower filter device is configured optimally, corresponding to the components of the blower filter system.

Especially advantageous is a system in which the checking unit is designed to determine whether the software of the control unit of the blower filter device is up to date.

According to a second aspect of the present invention, the object is accomplished by a process for checking and setting device-specific parameters of a blower filter device of a blower filter system of a system, which is designed according to the first aspect of the present invention, wherein the process is characterized by the following process steps, which are carried out especially one after another:

a) the blower filter system, especially the blower filter device, is switched on;

b) device-specific parameters are detected by the detecting means of the blower filter device and transmitted to the control unit;

c) the device-specific parameters are transmitted from the control unit to the checking unit of the blower filter system;

d) the device-specific parameters transmitted are checked in the checking unit, especially with respect to their up-to-state status; and e) data and/or device-specific parameters are sent from the computer via the communication interfaces to the control unit of the blower filter device as a function of the result of the checking and are stored there.

Such a process makes possible a flexible and rapid adaptation of the functionality of the blower filter system in a cost-effective and simple manner. This means that the computer can modify device-specific parameters and properties of the blower filter device or update them to the most up-to-date state by software updates. The detecting means of the blower filter device detects the device-specific parameters and passes these on to the control unit of the blower filter device. After transmission of the device-specific parameters to the checking unit, the device-specific parameters can be checked there and changes can be made in the device-specific parameters of the device-specific parameter device depending on the result. For example, most recent data sets for a correct automatic configuration of the blower filter system can thus be transmitted to the control unit of the blower filter device in case of an expansion of the blower filter system by a new component, such as a new filter or a new head piece. In particular, adaptation to use situations of the blower filter system can be performed via the computer; for example, the volume of the acoustic alarm system or a keyboard lock can be set.

If the checking unit is associated with the computer, the device-specific parameters are transmitted from the control unit to the computer in order for the latter to be able to perform the checking As an alternative hereto, the result of checking is transmitted from the control unit via the communication interfaces to the computer if the checking unit is arranged the blower filter device, especially in the control unit of the blower filter device, so that the computer will then be able to transmit corresponding device-specific parameters or data, especially software updates, back to the control unit of the blower filter device.

According to a preferred variant of the present invention, provisions may be made in a process for especially steps b) through e) to be carried out automatically after switching on the blower filter system, especially of the blower filter device. It is guaranteed hereby that immediately after the blower filter system has been switched on, a check is performed to determine whether the device-specific parameters are up to date, and an adaptation or modification of the blower filter system is performed, if necessary.

Preferred is a process in which the up-to-date status of the software of the control device of the blower filter device is detected by the checking unit and current software is transmitted from the computer via the communication interfaces to the control unit of the blower filter device depending on the detected up-to-date status of the software. It is ensured hereby that the blower filter system is always equipped with the most up-to-date software, so that the blower filter system can continue to be operated safely for a user in case of a reconfiguration of the blower filter system, for example, due to the replacement of a filter or of a head piece.

The data and device-specific parameters can be transmitted via a physical interface, especially via a cable between the control unit and the computer via a physical interface, especially via a cable between the control unit and the computer. It is especially preferred if the data and device-specific parameters are transmitted in a wireless manner between the control unit and the computer via the communication interfaces. This increases the flexibility of the blower filter system.

The present invention will be explained in more detail on the basis of the drawing figures attached. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
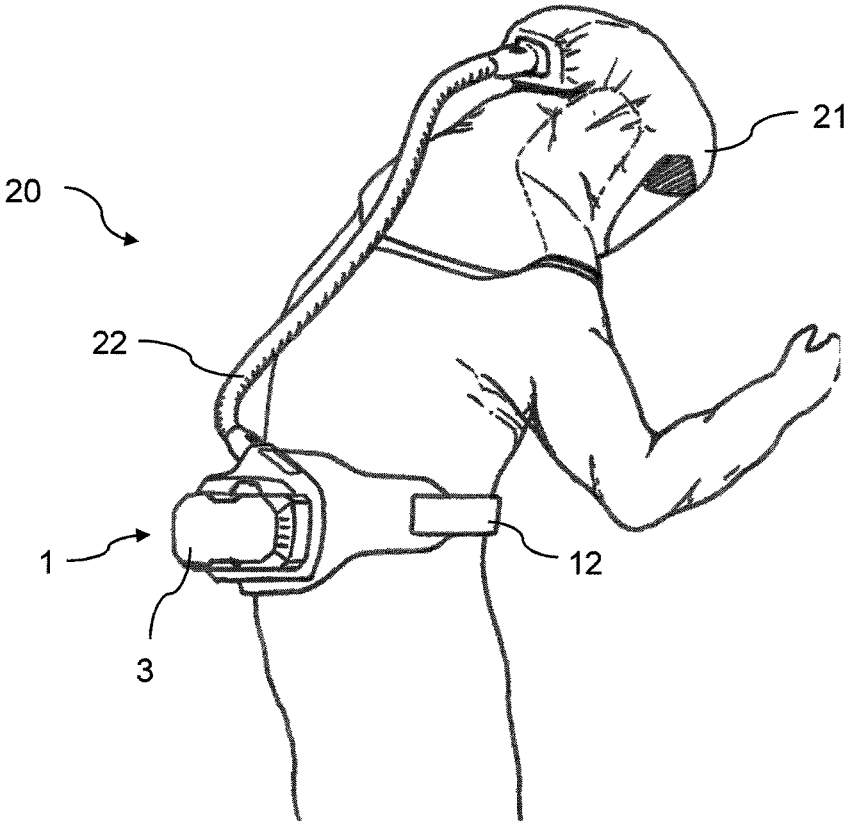
FIG. 1 is a schematic perspective view showing a blower filter system having a blower filter device, a head piece as well as a flexible connection hose.
Figure 2:
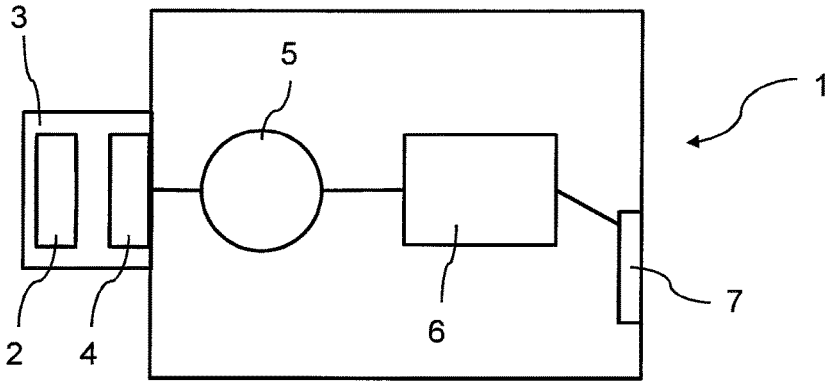
FIG. 2 is a schematic view showing a blower filter device of a blower filter system according to the design principles according to the present invention.
Figure 3:
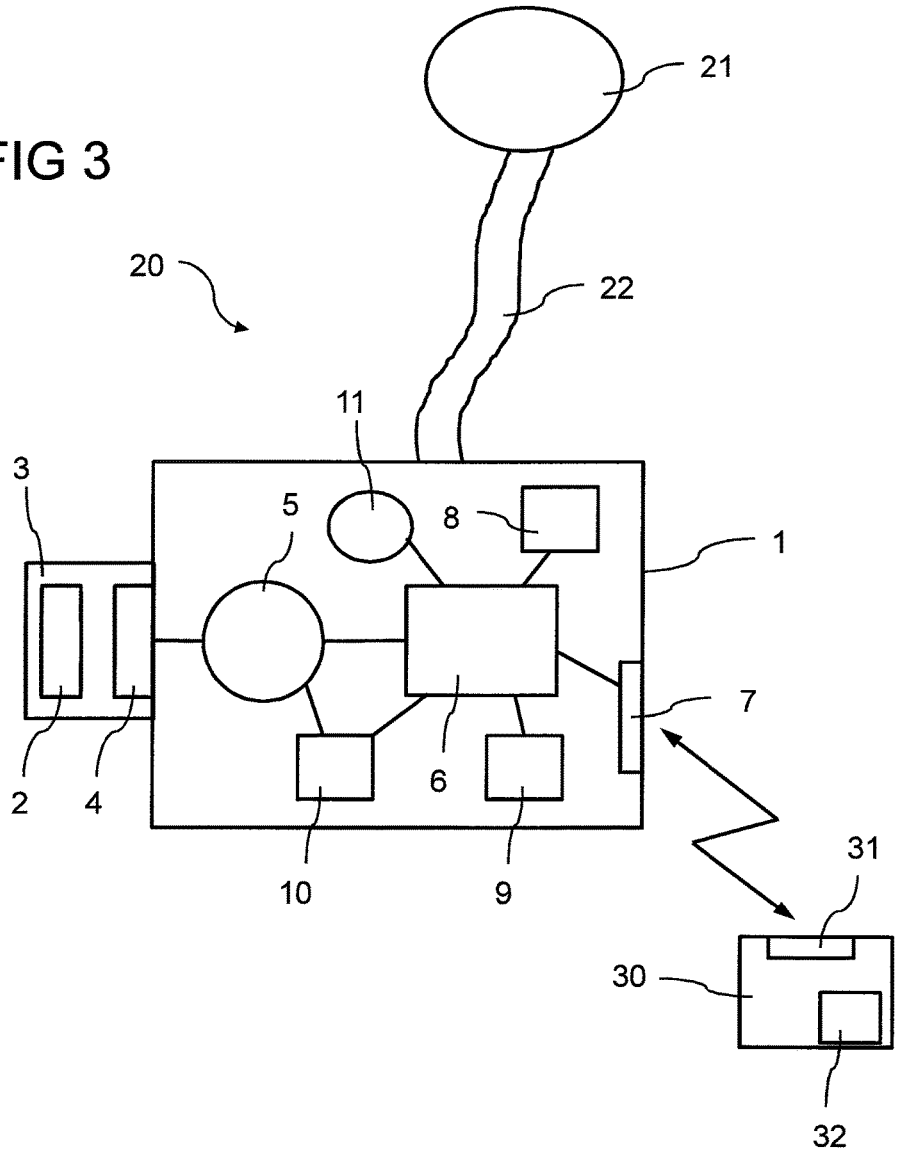
FIG. 3 is a schematic view showing a system having a blower filter system with a blower filter device, with a head piece as well with a flexible connection hose and having an external computer.

Referring to the drawings in particular, elements having the same function and mode of action are always designated by the same reference numbers in FIGS. 1 through 3.

FIG. 1 schematically shows a blower filter system 20, having a blower filter device 1, a head piece 21 as well as a flexible connection hose 22, which connects the blower filter device 1 and the head piece 21 to one another in a fluid-communicating manner. The blower filter device 1 is arranged on a carrying system 12 in the form of a belt, so that easy carrying is made possible to a user in any working environment. The blower filter device 1 has a fan housing 3, in which a fan wheel is arranged.

FIG. 2 schematically shows a blower filter device 1 of a blower filter system 20 of a system according to the present invention. Blower filter device 1 has a fan wheel 4, which is arranged in a fan housing 3 and is driven by a motor 5. A filter 2, which purifies the ambient air suctioned by the fan wheel 4, is arranged downstream of the fan wheel 4. A control unit 6, which is also used to process device-specific parameters of the blower filter device 1, is provided for actuating motor 5. Furthermore, blower filter device 1 has a communication interface 7. Communication interface 7 may be designed as a physical interface for connecting a cable or preferably as a wireless interface. Communication interface 7 is used to transmit data from the control unit 6 to an external computer 30, not shown, of the blower filter system 20, and/or to receive data sent from an external computer 30 to the control unit 6 of the blower filter device 1.

FIG. 3 schematically shows a system with a blower filter system 20 and with a computer 30, which system is designed according to the design principle of the present invention. The blower filter system 20 of the system has a blower filter device 1, a head piece 21, which may be designed as a helmet, as a mask, as a visor or as a mask, as well as a flexible connection hose 22, which connects the blower filter device 1 and the head piece 21 to one another in a fluid-communicating manner. In addition to the blower filter device 1 described in FIG. 2, the blower filter device 1 being shown in FIG. 3 has a battery 10, which is used to operate the motor 5 and the control unit 6. Battery 10 is preferably arranged replaceably at the blower filter device 1, so that replacement of the battery 10 or charging outside the blower filter device 1 is made possible. Blower filter device 1 has, furthermore, a detecting means 8 for detecting device-specific parameters of the blower filter device 1. The means 8 is connected to the control unit 6 in a data-communicating manner to transmit detected device-specific parameters and properties to the control unit 6. A user interface 9 makes it possible for a user to make settings on the blower filter device 1. A display unit 11 is used as a warning device, which can display a situation, especially a potentially hazardous situation, by visual and/or acoustic signaling. For example, a potentially hazardous situation can be displayed to the user of the blower filter system 20 by a conspicuous blinking of the display unit and/or the emission of a forceful warning sound. Blower filter device 1 may have one or more filters 2, and, in particular, different types of filters 2 may be combined with one another. Data and device-specific parameters can be transmitted via the communication interface 7 of the blower filter device 1 to a computer 30 of the blower filter system 20, which said blower filter device is arranged separated in space and received from same. Computer 30 has a communication interface 31 of a corresponding design, via which data and device-specific parameters, especially software updates, can be transmitted. Furthermore, computer 30 has a checking unit 32, which is used to check whether the device-specific parameters, especially the device-specific software, of the control unit 6 of the blower filter device 1 are up to date.

Control unit 6 of the blower filter device 1 may be designed for the automatic, especially periodic transmission of the device-specific parameters to the computer 30. This means that the control unit 6 transmits the device-specific parameters and properties of the blower filter device 1 detected by the detecting means 8, which also include the software of the blower filter device 1 downloaded on the data storage of the control unit 6, to the computer 30 of the blower filter system 20. An especially continuous checking of the device-specific parameters and settings for up-to-date status and correctness is performed in the checking unit 32 of the computer 30. If an incorrect setting or an incorrect or not-up-to-date device-specific parameter is detected, computer 30 sends updated data via the communication interface 31 to the blower filter device 1. Furthermore, it is easy for a service technician to read and analyze the operating parameters and operating settings of the blower filter system 20, especially of the blower filter device 1. The data transmitted to the computer can be used for statistical analyses. This may take place in a service computer or in a service server connected via the Internet. Changes, especially improvements, can be made on the blower filter systems 20 on the basis of the statistical analyses.

Such a blower filter system 20 makes possible a flexible and rapid adaptation of the functionality of the blower filter system 20 or of the blower filter device 1 of a blower filter system 20 in a cost-effective and simple manner.

The above explanation of the embodiments of the blower filter system 20 describes the present invention within the framework of examples.

Individual features of the embodiments, if technically meaningful, may, of course, be freely combined with one another without going beyond the scope of the present invention.

While specific embodiments of the invention have been shown and described in detail to illustrate the application of the principles of the invention, it will be understood that the invention may be embodied otherwise without departing from such principles.

APPENDIX

List of Reference Numbers

1 Blower filter device
2 Filter
3 Fan housing
4 Fan wheel
5 Motor
6 Control unit
7 Communication interface
8 Detecting means
9 User interface
10 Battery
11 Display unit
12 Carrying system
20 Blower filter system
21 Head piece
22 Flexible connection hose
30 Computer
31 Communication interface
32 Checking unit

What is claimed is:

1. A system comprising:

a blower filter system comprising: a blower filter device comprising at least one filter, a fan wheel arranged in a fan housing, a motor for driving the fan wheel, a control unit for actuating the motor and for processing device-specific parameters of the blower filter device, a blower filter device communication interface connected to the control unit and a detecting device detecting device-specific parameters of the blower filter system, indicating a component configuration of the blower filter system, detecting blower filter system properties obtained during the operation of the blower filter system and detecting blower filter system statistics obtained during the operation of the blower filter system, the detecting device being connected to the control unit in a data-communicating manner and transmitting detected device-specific parameters, indicating the component configuration of the blower filter system, transmitting the system properties and transmitting the system statistics to the control unit, the blower filter device communication interface being configured to transmit the detected device-specific parameters, the system properties and the system statistics from the control unit as blower filter system data; a head piece; and a flexible connection hose, connecting the blower filter device and the head piece to one another in a fluid-communicating manner; and a computer separated in space from the blower filter system, the computer having a computer communication interface to transmit data from the computer to the control unit of the blower filter device and to receive data sent from the control unit of the blower filter device to the computer, the blower filter device communication interface transmitting the blower filter system data from the control unit to the computer an receiving data sent from the computer to the control unit; and a checking unit as part of the computer and configured to determine whether device-specific parameters provided to the control unit of the blower filter device by the detecting device are up to date, including checking if present data sets of the blower filter system control unit correspond to the detected component configuration of the blower filter system, and to determine whether device-specific software, of the control unit of the blower filter device are up to date and to make predictions on a remaining service life of the blower filter system based on the system properties and system statistics and to transmit the predictions from the computer to the control unit via the blower filter device communication interface and the computer filter device communication interface whereby a user of the blower filter system is provided with remaining service life information as well as most recent data, settings and notifications in case of a malfunction, wherein:

the checking unit is configured for an automatic periodic polling of the device-specific parameters of the blower filter device with the automatic periodic polling including the detecting by the detecting device at the blower device and the transmitting by the blower filter device communication interface; and the computer sends data including software updates and device-specific parameters comprising device-specific setting data to the control unit of the blower filter device via the communication interfaces as a function of the determined device-specific parameters of the blower filter device to change the device-specific parameters of the blower filter device, wherein the checking unit is configured to determine whether the software of the control unit of the blower filter device is up to date and the blower filter device communication interface is configured to receive software updates for the control unit from the computer.

2. A system in accordance with claim 1, wherein the communication interface of the computer and the blower filter device communication interface each comprise a physical interface for connecting a cable or a wireless interface.

3. A system in accordance with claim 1, wherein the control unit is configured for an automatic transmission of device-specific parameters to the computer.

4. A system in accordance with claim 1, wherein the control unit is configured for a periodic transmission of device-specific parameters to the computer.

5. A process comprising the steps of:

providing a system comprising: a blower filter system comprising: a blower filter device comprising at least one filter, a fan wheel arranged in a fan housing, a motor for driving the fan wheel, a control unit for actuating the motor and for processing device-specific parameters of the blower filter device, processing blower filter system properties of the blower filter device and processing blower filter system statistics, a blower filter device communication interface connected to the control unit; a head piece; and a flexible connection hose, connecting the blower filter device and the head piece to one another in a fluid-communicating manner; a computer separated in space from the blower filter system, the computer having a computer communication interface to transmit data from the computer to the control unit of the blower filter device and to receive data sent from the control unit of the blower filter device to the computer, the blower filter device communication interface being configured to receive software updates for the control unit from the computer, for transmitting data from the control unit to the computer and receiving data sent from the computer to the control unit for checking and setting device-specific parameters of the blower filter device of the blower filter system of a system;

switching on the blower filter system including switching on the blower filter device;

detecting device-specific parameters of blower filter system, indicating a component configuration of the blower filter system, with a parameter detecting device of the blower filter device, the parameter detecting device being connected to the control unit with a data-communicating connection;

detecting blower filter system properties obtained during the operation of the blower filter system;

detecting blower filter system statistics obtained during the operation of the blower filter system;

transmitting the detected device-specific parameters, indicating the component configuration of the blower filter system, transmitting system properties and transmitting system statistics to the control unit and transmitting the detected device-specific parameters, system properties and system statistics from the control unit to the computer via the blower filter device communication interface and the computer communication interface;

checking the transmitted device-specific parameters with respect to whether the transmitted device-specific parameters are up to date, including checking if present data sets of the blower filter system control unit correspond to the detected component configuration of the blower filter system and determining whether the software of the control unit of the blower filter device is up to date, using a checking unit as part of the computer configured as the checking unit and making predictions on a remaining service life of the blower filter system based on the system properties and system statistics;

transmitting data comprising device-specific parameters, including device-specific setting data, data sets, software updates and the predictions, from the computer via the communication interfaces to the control unit of the blower filter device as a function of the result of the checking; and storing the transmitted data comprising new device-specific parameters, including new device-specific setting data, data sets and software updates, at the blower filter device to change the device-specific parameters of the blower filter device and including the predictions, whereby a user of the blower filter system is provided with remaining service life information as well as most recent data, settings and notifications in case of a malfunction, wherein the checking unit is configured for an automatic periodic polling of the device-specific parameters of the blower filter device with the automatic periodic polling including the detecting by the detecting device at the blower device and the transmitting by the blower filter device communication interface.

6. A process in accordance with claim 5, wherein the checking unit is associated with the computer, wherein the device-specific parameters are transmitted from the control unit to the computer for the step of checking.

7. A process in accordance with claim 5, wherein the checking unit is arranged in the blower filter device and is associated with the control unit of the blower filter device; and a result of checking is transmitted from the control unit to the computer via the communication interfaces.

8. A process in accordance with claim 5, wherein the steps of detecting device-specific parameters, transmitting the detected device-specific parameters, checking the transmitted device-specific parameters, transmitting data comprising device-specific parameters from the computer via the communication interfaces to the control unit of the blower filter device as a function of the result of the checking and storing are carried out automatically after the step of switching on the blower filter system including switching on the blower filter device.

9. A process in accordance with claim 5, wherein the checking unit determines whether the software of the control unit of the blower filter device is up to date and current software is either transmitted from the computer via the communication interfaces to the control unit of the blower filter device or not depending on the determined up-to-date status of the software.

10. A process in accordance with claim 5, wherein the data and device-specific parameters are transmitted via the communication interfaces between the control unit and the computer in a wireless manner.

11. A system in accordance with claim 1, wherein:

the detecting device comprises sensors which recognize a component configuration of the blower filter system to detect changes in the components of the blower filter system; and the computer is configured to send device-specific setting data that includes sending data sets corresponding to the detected component configuration of the blower filter system.

12. A process in accordance with claim 5, wherein:

the detecting of device-specific parameters comprises sensing a component configuration of the blower filter system with sensors at the blower filter device to detect changes in the components of the blower filter system; and transmitting data from the computer includes sending changed device-specific parameters includes sending data sets corresponding to the detected component configuration of the blower filter system.

* * * * *